United States Patent [19]

White et al.

[11] Patent Number: 4,555,128

[45] Date of Patent: Nov. 26, 1985

[54] FOLDABLE SUPPORT STAND

[76] Inventors: Stephen R. White, 3 Florence Ave., Binghamton, N.Y. 13905; Jeffrey N. Feinberg, 6 Brookside Rd., Binghamton, N.Y. 13903

[21] Appl. No.: 575,699

[22] Filed: Jan. 31, 1984

[51] Int. Cl.[4] ..... B42D 9/00

[52] U.S. Cl. ..... 281/45; 248/456; 281/31

[58] Field of Search ..... 248/448, 456; 281/30, 281/31, 33, 45, 48

[56] References Cited

U.S. PATENT DOCUMENTS

| | | | |
|---|---|---|---|
| 756,486 | 4/1904 | Fleming | 108/9 |
| 1,203,659 | 11/1916 | Smith | 248/456 |
| 1,540,524 | 6/1925 | Anderson | 281/33 |
| 1,564,594 | 12/1926 | Leh | 248/448 |
| 1,848,980 | 3/1932 | Walker | 281/31 X |
| 2,014,176 | 3/1934 | Henderson | 248/456 |
| 2,160,180 | 5/1939 | Stone | 206/93 |
| 2,318,192 | 5/1943 | Boelema, Jr. | 281/31 |
| 3,381,928 | 5/1968 | White | 248/455 X |
| 4,162,800 | 7/1979 | Gonot, Jr. et al. | 281/48 X |
| 4,199,173 | 4/1980 | Greenlees | 281/45 |
| 4,296,946 | 10/1981 | Larre et al. | 281/45 |

FOREIGN PATENT DOCUMENTS

| | | | |
|---|---|---|---|
| 12167 | of 1915 | United Kingdom . | |
| 467269 | 6/1937 | United Kingdom | 248/456 |

OTHER PUBLICATIONS

Application describing admitted prior art.

*Primary Examiner*—Paul A. Bell

*Attorney, Agent, or Firm*—Schwartz, Jeffery, Schwaab, Mack, Blumenthal & Evans

[57] ABSTRACT

The support device can be used as a reading stand or a writing support surface. The device includes a base portion, an upper support panel having two sides, a hinge connecting the base portion to one side of said support panel and a page holder for holding the pages of a book open against the support panel. The page holder comprises an elastic band having opposite ends attached to the support panel. The elastic band is sufficiently long to stretch over the other side of said support panel.

9 Claims, 5 Drawing Figures

FIG. 3.
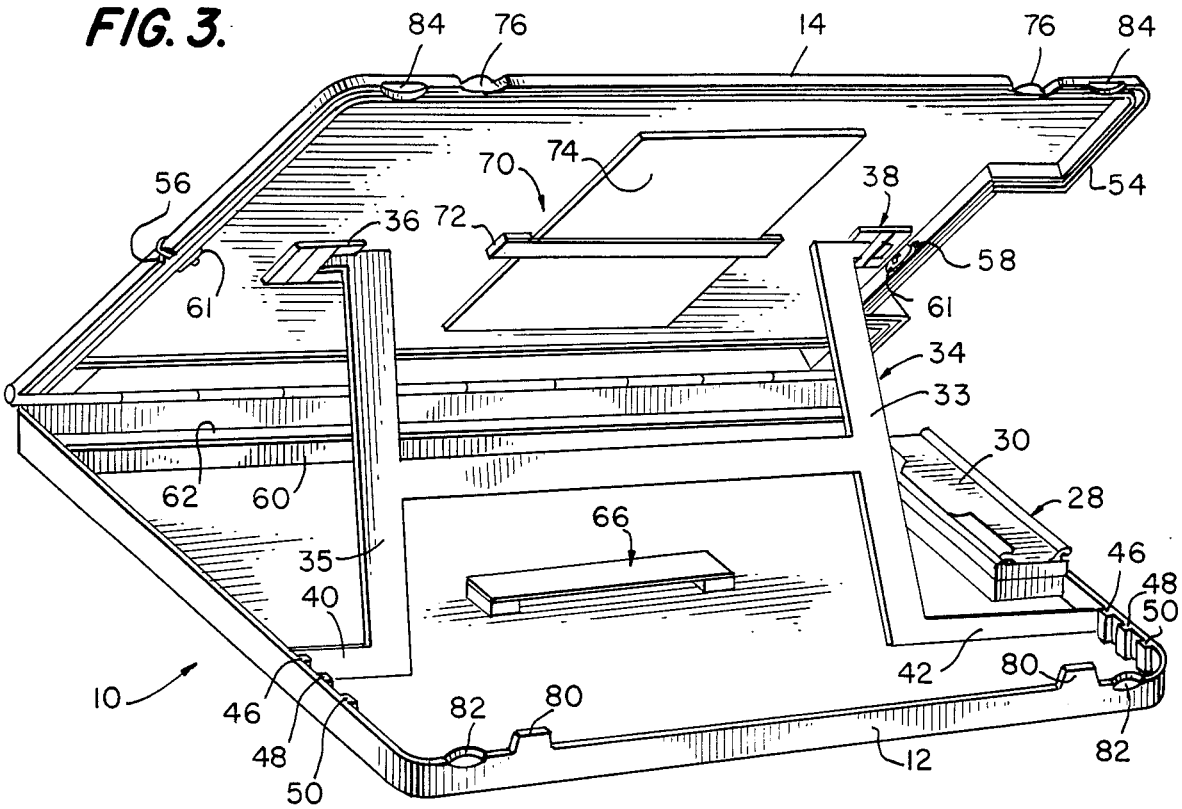
FIG. 5.
FIG. 4.
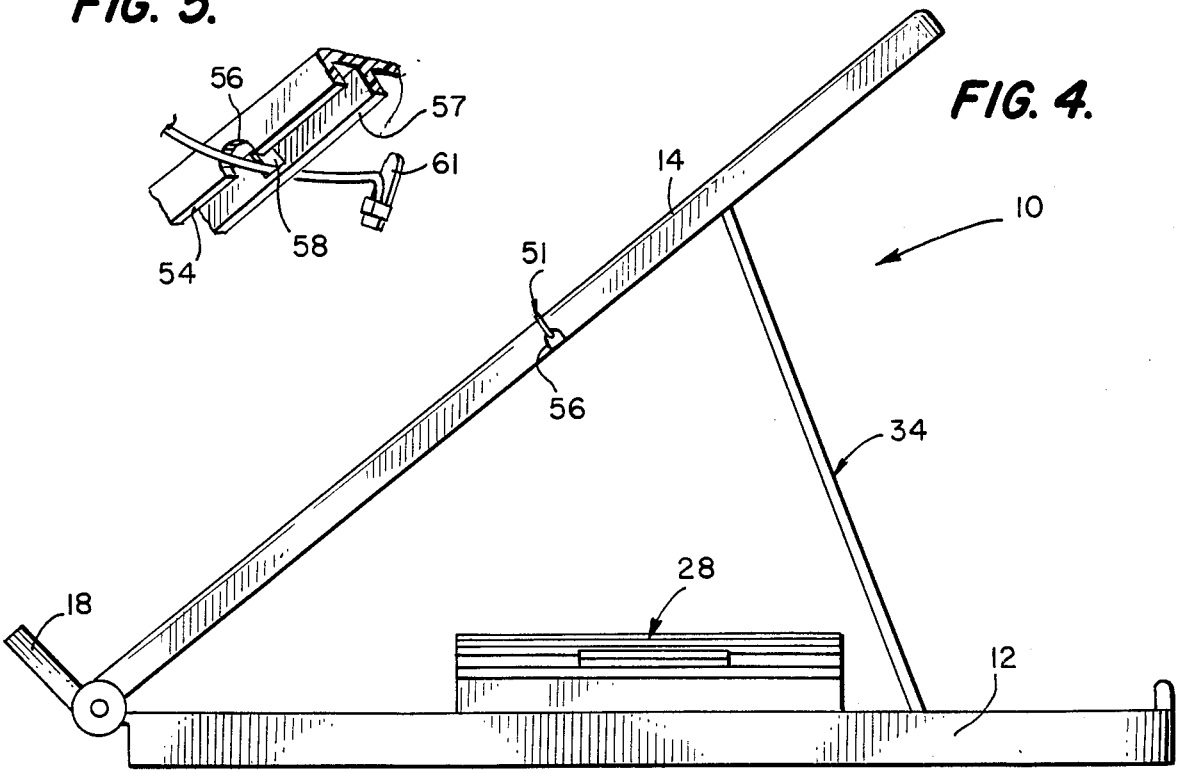

FOLDABLE SUPPORT STAND

BACKGROUND OF THE INVENTION

1. Field of the Invention

The present invention relates to a support device which can be used as a reading stand or a writing support, and more particularly to such a support device which contains a storage compartment and which can be folded into a compact configuration for portability or to an angled configuration to act as a book support.

2. Discussion of Related Art

Foldable reading stands, book stands, copy holders and like devices are known. However, these devices are deficient in several areas.

Some known devices either lack sufficient rigidity and/or stability and are too bulky and cumbersome to be widely useful. Thus, a need has arisen for strong yet portable support devices.

Furthermore, some known devices have been limited to the role of bookrest or copyholder. Thus, anyone desiring both a portable reading stand and a writing board would be required to separately purchase each such device and carry both from place to place.

Although some devices are known which function both as a bookrest and a copy holder, and are relatively portable, these known devices are relatively difficult to use and require manipulation of a book or the like in order to turn pages. Also, these known devices do not provide storage space so that writing implements, books, pads, etc. must be carried separately.

SUMMARY OF THE INVENTION

An object of the present invention is to provide a support stand which can function both as a bookrest and a copy holder.

Another object of the present invention is to provide a support stand which can easily be folded into a compact configuration for carrying the stand and can be unfolded into a rigid, stable support and yet is not bulky or cumbersome to use.

An additional object of the present invention is to provide a support stand which incorporates a storage area for writing implements, small books, pads, etc.

In accordance with the above and other objects, the present invention is a support stand which can be used as a reading stand or a writing support surface. The support stand comprises a base portion, an upper support panel having two sides, a hinge connecting the base portion to one side of said support panel, and page holder means for holding the pages of a book open against the support panel. The page holder means comprises an elastic band having opposite ends attached to the support panel. The elastic band is sufficiently long to stretch over the other side of said support panel.

The base has an inner storage area and the support panel can be pivoted to a position covering the inner storage area.

Also, the device includes a lip connected to the hinge for rotation between a position aligned with the support panel to form a writing surface, and a position extending upwardly from the support panel to serve as a book support. The base includes a pencil storage compartment, and the pencil storage compartment is positioned beneath the lip such that the lip forms a cover to the pencil storage compartment.

The device may further include a hole formed in the support panel for receiving and supporting a writing implement.

The device may also have a support bracket for holding the support panel at an angulated position relative to the base. The support bracket has an H-shape.

A support extension may be slidably attached to the support panel for movement to a position extending beyond the other side of said support panel.

The device may also include a bracket formed in the base for holding a calculator. Further, a clip unit having a spring loaded clip may be mounted in the base such that the spring loaded clip extends above the support panel when the support is in the closed position.

BRIEF DESCRIPTION OF THE DRAWINGS

The above and other objects will become more readily apparent as the invention becomes more fully understood from the detailed description to follow, reference being had to the accompanying drawings in which like reference numerals represent like parts throughout, and in which:

FIG. 3 is a perspective view of the device according to the present invention showing the brace and storage areas of the device; and FIG. 4 is a side elevational view of the device shown in its opened position.

FIG. 5 is an enlarged view showing the connection of one end of the elastic band to the support panel.

DETAILED DESCRIPTION OF THE PREFERRED EMBODIMENT

Figure 1:
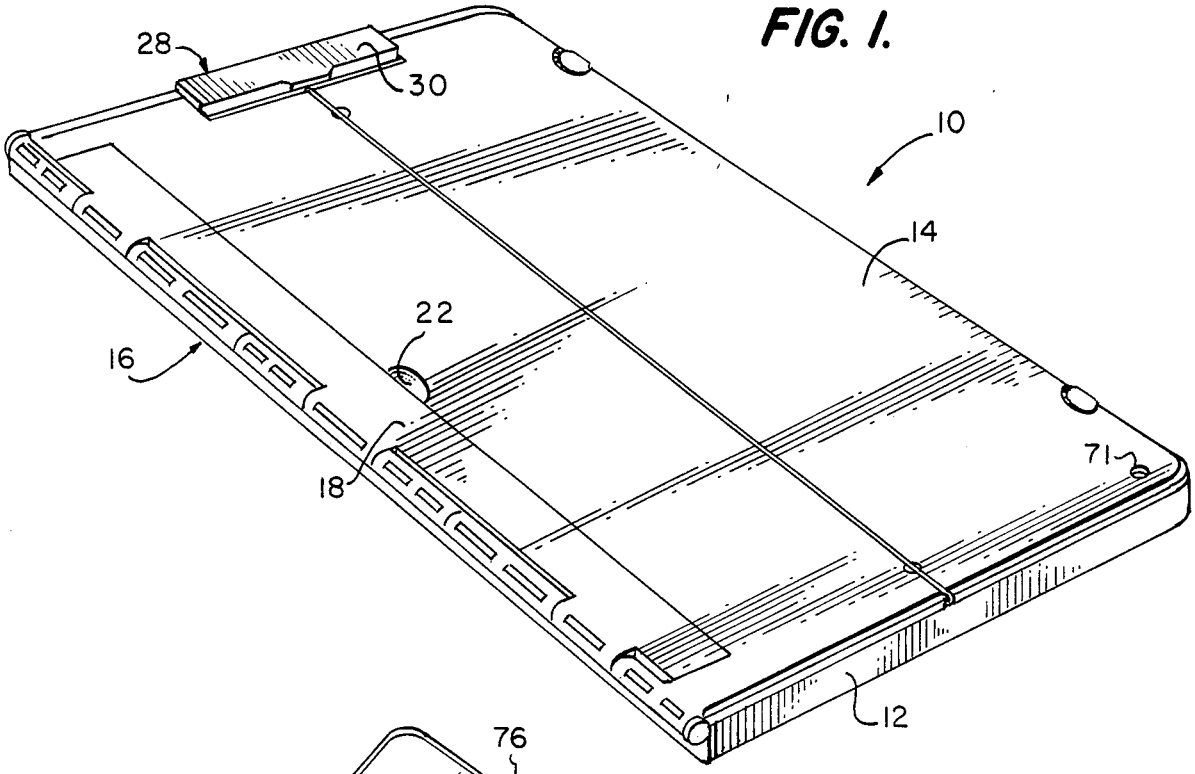
FIG. 1 is a perspective view of the device according to the present invention positioned to be used as a writing surface and carrying case.
Figure 2:
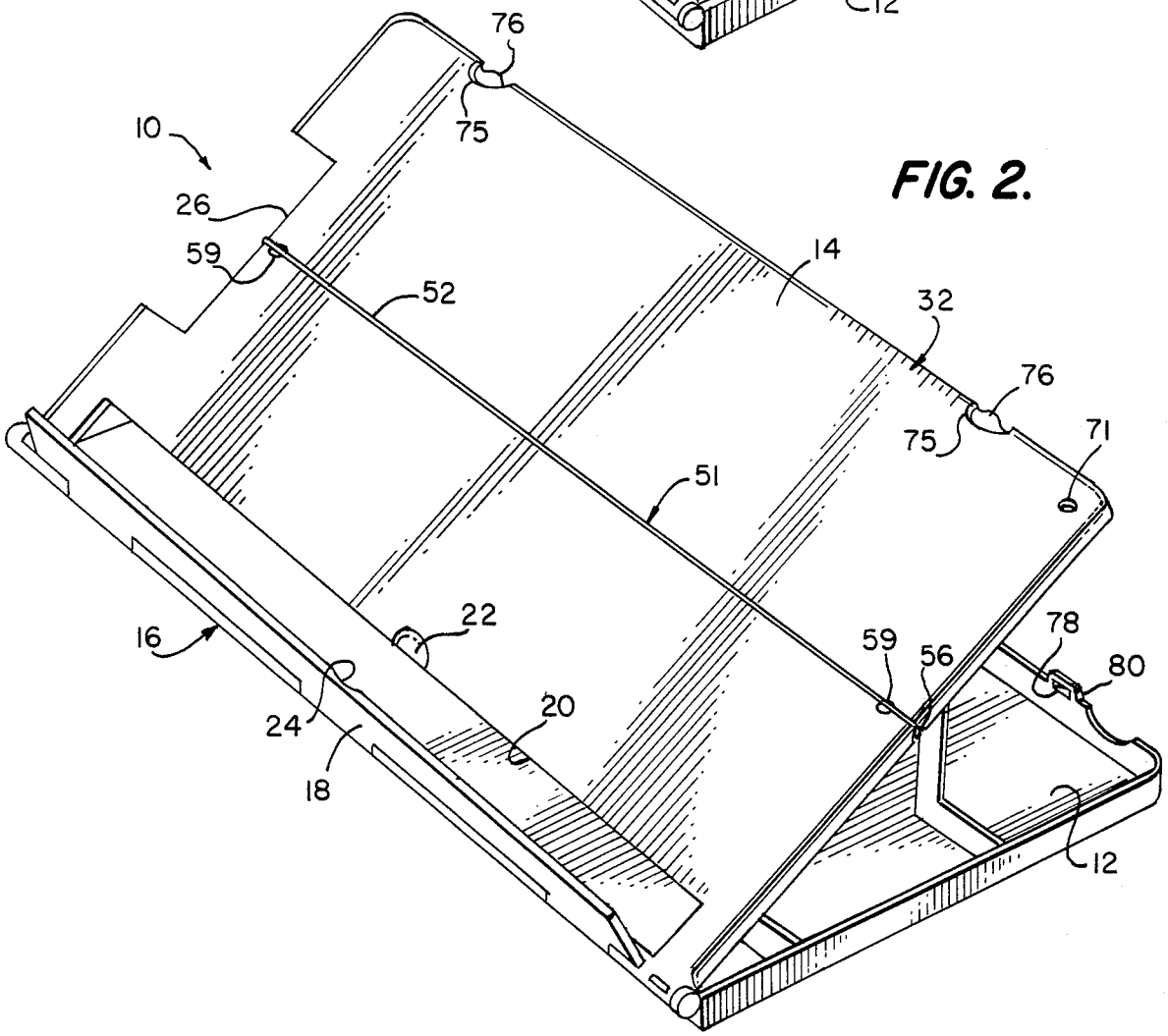
FIG. 2 is a perspective view of the device according to the present invention in which the device is opened for use as a reading stand.

FIGS. 1 and 2 show the support stand 10 of the present invention to include a lower base section 12, an upper support panel 14, and a hinge 16 which interconnects lower base 12 with upper support panel 14. A lip 18 is also connected to hinge 16. Base 12, support panel 14 and lip 18 are mutually pivotable relative to each other about hinge 16. Support panel 14 can be pivoted from a closed, writing support position, shown in FIG. 1, in which the support panel 14 rests directly upon base 12 to an open reading stand position shown in FIG. 2. Support panel 14 contains a through-opening 20 to receive lip 18. In the writing support position shown in FIG. 1, lip 18 is received in opening 20 so that the upper surface of lip 18 is aligned with the upper surface of upper support 14 to form a planar writing surface. Aligned recesses 22 and 24 are formed in the support panel 14 and lip 18, respectively, to facilitate removal of lip 18 from opening 20.

Support panel 14 also contains a clip recess 26 which extends around a clip unit 28 which is mounted on base 12. Clip unit 28 is shown more clearly in FIG. 3. When the support panel 14 is moved to the writing support position in FIG. 1, clip unit 28 extends above the surface of support panel 14. Clip unit 28 contains a spring-loaded clip 30 which functions to hold a pad of paper or the like against the support panel 14.

On the free side of support panel 14, opposite hinge 16, ruler markings 32 are formed so that the support panel 14 can be used as a ruler if need be.

FIGS. 2, 3 and 4 show the support stand 10 in its reading stand position wherein support panel 14 is pivoted upwardly from base 12 and held at an angled position by a brace 34. Bracket 34 is H-shaped and connected at hinge joints 36 and 38 to the bottom of support panel 14. Base 12 has a depth of approximately ⅜ inch to receive pads, papers, etc. which can be stored in the base. The bottom of bracket 34 between the sides 33, 35 of the H is wide enough to span a legal size pad and papers resting inside of base 12 so as not to interfere with removal of these items from base 12. A pair of laterally extending legs 40 and 42 are attached, respectively, to the opposite sides 35,33 of bracket 34. Legs 40 and 42 rest on the bottom of base 12 and are pressed against pairs of spaced stops 46, 48 and 50 formed along the sides of base 12. Accordingly, the angular position of support panel 14 can be varied by moving legs 40, 42 between stops 46, 48 and 50.

When support panel 14 is to be closed to the writing support position, support panel 14 is raised so that legs 40 and 42 are above clip unit 28. Bracket 34 is then folded so that legs 40, 42 are moved toward hinge 16. In this position, bracket 34 rests against the bottom of support panel 14 and the support panel can be closed onto base 12.

In the reading stand position, lip 18 is rotated out so that it is approximately 90° to support panel 14, as clearly shown in FIG. 4. A conventional stop (not shown) is provided on lip 18 to prevent rotation beyond this position. In this position, lip 18 holds the bottom of a book being supported on the reading stand. In order to hold the book open, an elastic page holder 51 is provided. Page holder 51 is in the form of an elastic band 52 which extends for the length of support panel 14. The ends of elastic band 52 extend around opposite ends of support panel 14. As shown in FIGS. 3 and 5, the peripheral edge of support panel 14 has a ridge 54 to add additional strength. A recess 56 is formed in the ridge 54 and elastic band 52 is passed through ridge 56. A second ridge 57 is also formed around the periphery of support panel 14 at a position spaced inwardly from ridge 54. Ridge 57 has holes 58 formed therein in alignment with recesses 56. A clip 61 is crimped onto each end of elastic band 52 and is passed through an opening 58, turned sideways and held against the inside of ridge 57 by band 52.

Preferably, the support panel 14 and the base 12 are injection molded from a durable synthetic resin such as polypropylene. Of course, the design of these elements must be adapted to suit the injection molding process. For example, it will be noted that holes 59 are fomred in the top of support panel 14. The only purpose for holes 59 is to permit the mold to extend into ridge 57 to form holes 58.

Page holder 51 has the advantage that one does not have to remove the book from the reading stand in order to turn the page. One simply lifts the page holder and turns the pages of the book while the base of the book is supported on lip 18. Furthermore, elastic page holder 51 will hold thick, heavy and large books as easily as thin, light books by virtue of the elastic band 52 stretching to accomodate any size. On the other hand when the support stand is to be used as a writing support, elastic band 52 is sufficiently flexible to stretch over the free side of support panel 14 and be positioned on the back of support panel 14. In this case, band 52 will extend between ridges 57 on the back of panel 14 and not interfere with paper placed on the upper surface of panel 14.

As seen in FIG. 3, a wall 60 is formed inside base 12 to produce a storage area 62 for pens, pencils, and the like. The width of storage area 62 is equal to the width of lip 18 so that lip 18 can serve as a cover for storage area 62. In this manner, with the support stand 10 in its closed position shown in FIG. 1, access to pens and pencils can be achieved by merely rotating lip 18 upwardly and the entire support stand 10 need not be opened.

Also formed inside base 12 is a molded band 66 which can be used to hold and stabilize smaller items such as calculators and the like. Band 66 is positioned so as not to interfere with the positioning of pads in base 12.

Also as shown in FIG. 3, is a paper support device 70 which can be used to help support legal size sheets of paper. Device 70 includes a bracket 72 attached to the back of support panel 14 and a solid support member or support extension 74 which is received in bracket 72 and can be slid upwardly past the edge of support panel 14 to support papers which extend past the edge.

Referring again to FIGS. 1 and 2, it will be seen that a through-opening 71 is formed in support panel 14. Opening 71 can receive pens, pencils and other writing implements to serve as a support for these implements.

In order to hold support panel 14 in the closed position on base 12, recesses 75 are formed on the side of the panel 14. Small extensions 76 are formed in recesses 75. Extensions 76 fit into recesses 78 formed in upwardly extending protrusions 80 on base 12. Finger recesses 82 and 84 are formed on the base 12 and support panel 14, respectively, to assist in opening the support stand 10.

The foregoing description is set forth for the purpose of illustrating the present invention but is not meant to limit the scope thereof. Clearly, numerous additions, substitutions and other changes can be made to the present invention without departing from the scope thereof as set forth in the appended claims.

What is claimed is:

1. A support device which can be used as a reading stand or a writing support surface, comprising:
   - a base portion;
   - an upper support panel having upper and lower surfaces;
   - a hinge connecting said base portion to one edge of said support panel; and
   - page holder means for holding the pages of a book open against the upper surface of said support panel, said page holder means comprising an elastic band having opposite ends attached to the lower surface of said support panel, said elastic band being sufficiently long to stretch over the upper surface of said support panel and being movable between two positions, in one of said positions said elastic band being stretched along said upper surface to hold a book thereon and in said other position being disposed along said lower surface for storage when said support device is used as a writing support surface.

2. A device according to claim 1, further including a hole formed in said support panel for receiving and supporting a writing implement.

3. A device according to claim 1, further including a support bracket for holding said support panel at an angulated position relative to said base, said support bracket having an H-shape.

4. A device according to claim 1, further including a support extension slidably attached to said support panel for movement to a position extending beyond said support panel.

5. A device according to claim 1 including a bracket formed in said base for holding a calculator.

6. A device according to claim 1, wherein said base has an inner storage area and wherein said support panel can be pivoted to a position covering said inner storage area.

7. A device according to claim 6 including means for holding said support panel in said covering position.

8. A device according to claim 6 including a clip unit having a spring loaded clip, said clip unit being mounted in said base such that said spring loaded clip extends above said support panel when said support is in said closed position.

9. A support device which can be used as a reading stand or a writing support surface, comprising:

a base portion;

an upper support panel having upper and lower surfaces;

a hinge connecting said base portion to one edge of said support panel;

page holder means for holding the pages of a book open against said support panel, said page holder means comprising an elastic band having opposite ends attached to said support panel, said elastic band being sufficiently long to stretch over the upper surface of said support panel; and a lip connected to said hinge for rotation between a position aligned with said support panel to form a writing surface, and a position extending upwardly from said support panel to serve as a book support, and further wherein said base includes a pencil storage compartment, said pencil storage compartment being positioned beneath and aligned with said lip such that, with said lip raised, the pencil compartment is accessible through said support panel.

* * * * *